US010234215B2

(12) United States Patent
Rong et al.

(10) Patent No.: US 10,234,215 B2
(45) Date of Patent: Mar. 19, 2019

(54) MOUNTING CLIP

(71) Applicants: TRANE INTERNATIONAL INC., Davidson, NC (US); TRANE AIR CONDITIONING SYSTEMS (CHINA) CO., LTD., Jiangsu (CN)

(72) Inventors: Wei Guang Rong, Jiangsu (CN); Bin Bin Chen, Shanghai (CN); Yong Zhang, Shanghai (CN)

(73) Assignees: TRANE INTERNATIONAL INC., Davidson, NC (US); TRANE AIR CONDITIONING SYSTEMS (CHINA) CO, LTD., Jiangsu (CN)

( * ) Notice: Subject to any disclaimer, the term of this patent is extended or adjusted under 35 U.S.C. 154(b) by 0 days.

(21) Appl. No.: 15/511,177

(22) PCT Filed: Sep. 15, 2014

(86) PCT No.: PCT/CN2014/086540

§ 371 (c)(1),
(2) Date: Mar. 14, 2017

(87) PCT Pub. No.: WO2016/041131

PCT Pub. Date: Mar. 24, 2016

(65) Prior Publication Data

US 2017/0276439 A1 Sep. 28, 2017

(51) Int. Cl.
*F28F 9/00* (2006.01)
*F28F 9/007* (2006.01)

(52) U.S. Cl.
CPC ..... *F28F 9/007* (2013.01); *F28F 9/002* (2013.01); *F28F 2275/085* (2013.01)

(58) Field of Classification Search
CPC ..... F28F 9/007; F28F 9/002; F28F 2275/085; F28F 9/0131; F28F 9/10; B62D 25/084; B60K 11/04
(Continued)

(56) References Cited

U.S. PATENT DOCUMENTS 3,017,160 A * 1/1962 Lee ..... F24D 5/00 165/101
5,570,737 A 11/1996 Tokutake
(Continued)

FOREIGN PATENT DOCUMENTS

| | | |
|---|---|---|
| CN | 1099462 A | 3/1995 |
| CN | 2342343 | 10/1999 |
| EP | 0484004 A1 | 5/1992 |

OTHER PUBLICATIONS

International Search Report and Written Opinion, International Patent Application No. PCT/CN2014/086540, dated Jun. 18, 2015 (7 pages).

*Primary Examiner* — Davis D Hwu
(74) *Attorney, Agent, or Firm* — Hamre, Schumann, Mueller & Larson, P.C.

(57) ABSTRACT

A mounting clip that can be used to mount a heat exchanger to a housing, for example, in a HVAC system is disclosed. The mounting clip may include a receiver portion configured to receive, for example, an end portion of the heat exchanger. The mounting clip may also include a clip portion configured to secure the mounting clip to the housing. The mounting clip can be used to mount the heat exchanger to the housing relatively easily, reducing the manufacturing cost and time of the HVAC system.

16 Claims, 5 Drawing Sheets

(58) Field of Classification Search
USPC ..... 165/67
See application file for complete search history.

(56) References Cited

U.S. PATENT DOCUMENTS

| | | | | |
|---|---|---|---|---|
| 5,685,364 | A | 11/1997 | Harris | |
| 7,117,927 | B2 * | 10/2006 | Kent | F28F 9/002 165/67 |
| 2004/0261973 | A1 | 12/2004 | Kent et al. | |

* cited by examiner

MOUNTING CLIP

FIELD

The disclosure herein relates to a mounting clip. More specifically, the disclosure relates to a mounting clip configured to help mount a heat exchanger (e.g. a microchannel heat exchanger) to, for example, a housing in a heating, venting and air conditioning (HVAC) unit (e.g. a chiller), which may be employed in a HVAC system.

BACKGROUND

In a HVAC unit (e.g. a chiller), one or more heat exchangers (e.g. a heat exchange bank) may be used as a condenser and/or evaporator. For example, in some HVAC units, a condenser may be an outdoor unit, having one or more heat exchangers configured as heat exchange banks, and one or more fans. The heat exchanger(s) are mounted on supportive structures on the outdoor unit.

SUMMARY

A mounting clip that is configured to help mount a heat exchanger to a housing, for example, in a HVAC unit is disclosed. The mounting clip may include a receiver portion configured to receive, for example, a portion (e.g. an end portion) of the heat exchanger. The mounting clip may also include a clip portion configured to secure the mounting clip to the housing, so as to secure the heat exchanger to the housing. The mounting clip can be used to mount the heat exchanger to the housing relatively easily, reducing the manufacturing cost and time of the HVAC unit and/or system.

In some embodiments, the receiver portion may include an opening that is configured to receive the heat exchanger. In some embodiments, the clip portion may include a clip and a support, and the clip and the support may be configured to engage a structural component of the HVAC unit. In some embodiments, the structural component may be on a housing of an outdoor unit of the HVAC unit, such as one or more beams, panels, frames, and/or other suitable structural supports of the housing. The structural component is configured to have a structure and arrangement so as to engage or otherwise accommodate engaging features of the mounting clips. The mounting clip can be used to mount the heat exchanger to the structural component of the housing.

In some embodiments, the clip may include an engaging member, and the engaging member may be configured to engage the structural component in a mounting opening of the structural component. In some embodiments, the support may include a protruded engaging part, and the protruded engaging part may be configured to engage the structural component in a mounting opening of the structural component.

In some embodiments, the engaging member of the clip may be configured to be lower than a height of the protruded engaging part. In some embodiments, the clip may include a tab having an end that is configured to angle away from the receiver portion. In some embodiments, the clip may be supported by a supporting wall. The engaging member of the clip and the protruded engaging part of the support can help retain the clip (and the heat exchanger) on the structural component.

Other features and aspects of the systems, methods, and control concepts will become apparent by consideration of the following detailed description and accompanying drawings.

BRIEF DESCRIPTION OF THE DRAWINGS

Reference is now made to the drawings in which like reference numbers represent corresponding parts throughout.

DETAILED DESCRIPTION

In a HVAC unit, a heat exchanger may be mounted to a housing of an HVAC unit (e.g. a housing of an outdoor condenser unit), for example, by a plurality of screws. However, mounting the heat exchanger to the housing with screws can be time consuming, increasing the manufacturing time and cost.

Embodiments disclosed herein are related to a mounting clip that can be used to mount a heat exchanger to a housing, for example, in a HVAC unit and/or system. In some embodiments, the mounting clip may include a receiver portion configured to receive, for example, an end portion of the heat exchanger. In some embodiments, the mounting clip may include a clip portion configured to secure the mounting clip to the housing (e.g. a structural component of the housing). The mounting clip can help mount the heat exchanger to the housing relatively easily, reducing the manufacturing cost and time of the HVAC unit.

References are made to the accompanying drawings that form a part hereof, and in which is shown by way of illustration of the embodiments in which the embodiments may be practiced. It is to be understood that the terms used herein are for the purpose of describing the figures and embodiments and should not be regarded as limiting the scope.

Figure 1:
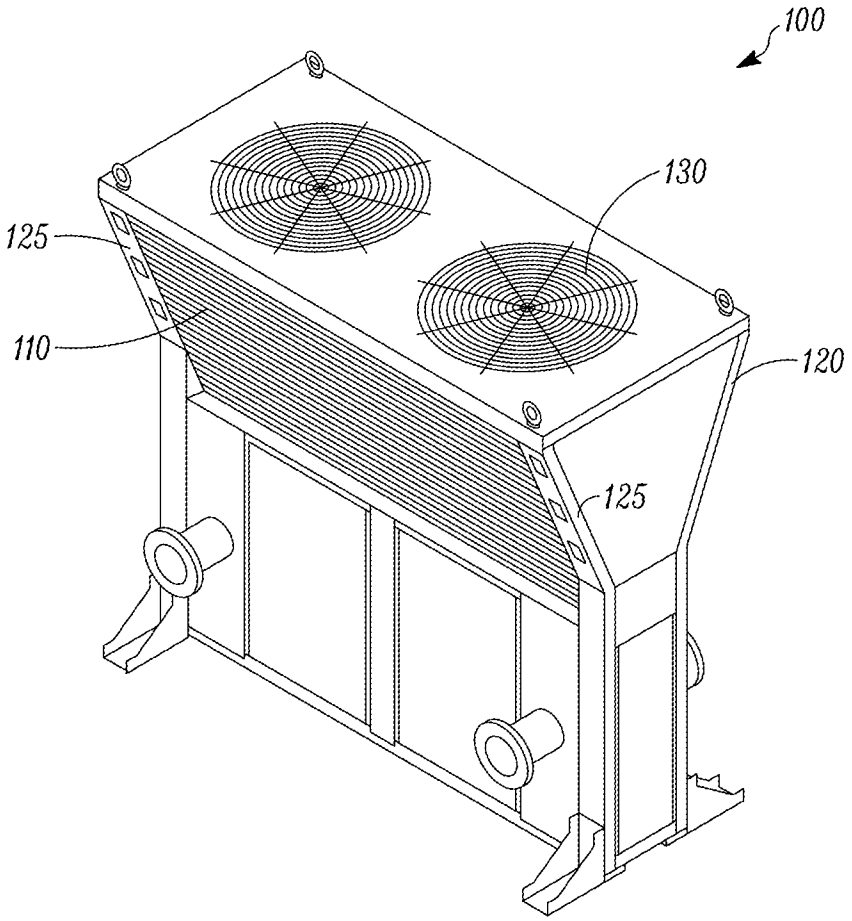
FIG. 1 illustrates a perspective view of an outdoor unit of a HVAC unit, with which the embodiments as disclosed herein can be practiced.

FIG. 1 illustrates an outdoor unit 100 (HVAC unit) of a HVAC system, with which the embodiments as disclosed herein can be practiced. The outdoor unit 100 can be configured, for example, to house a condenser of the HVAC system for example as part of a circuit of the HVAC system, with the understanding that the outdoor unit 100 can be configured to house other components of the HVAC unit.

The outdoor unit 100 may include a heat exchanger 110, a housing 120, and one or more fans 130. The heat exchanger 110 can be mounted to one or more structural components 125 (e.g. a structural support such as a beam) of the housing 120. Mounting the heat exchanger 110 to the housing 120 can help stabilize the heat exchanger 110.

Further, mounting the heat exchanger 110 to the housing 120 may also help form a seal between the heat exchanger 110 and the housing 120 (e.g. form a seal between the heat exchanger 110 and the one or more structural components 125). The seal can help prevent/reduce an airflow from bypassing the heat exchanger 110.

Figure 2:
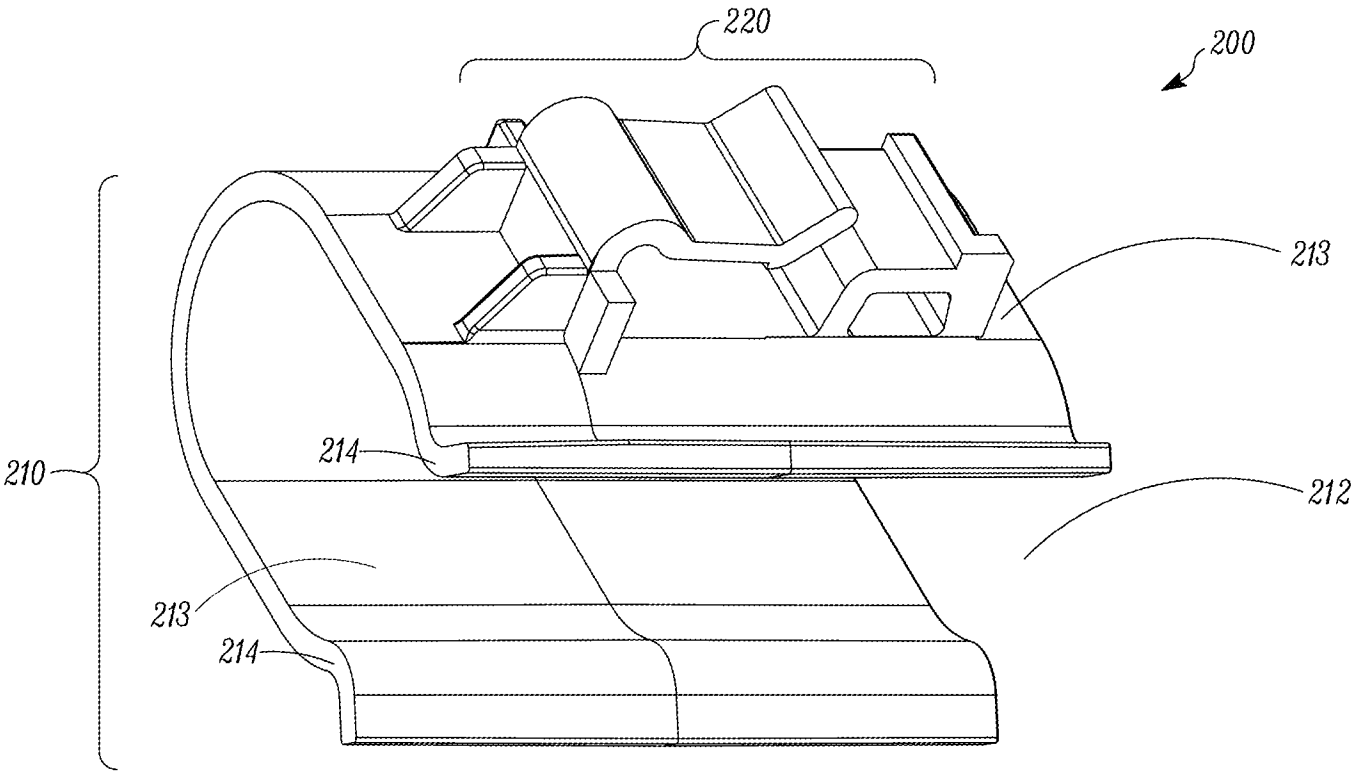
FIG. 2 illustrates a perspective view of a mounting clip, according to one embodiment of the disclosure.

FIG. 2 illustrates one embodiment of a mounting clip 200 that can be used to help mount a heat exchanger (e.g. the heat exchanger 110 in FIG. 1) to a housing (e.g. the housing 120) of an outdoor unit (e.g. the outdoor unit 100 in FIG. 1) in a HVAC unit.

The mounting clip 200 may include a receiver portion 210 that is configured to receive a heat exchanger. The mounting clip 200 may also include a clip portion 220 that is configured to help mount the mounting clip 200 to a housing (e.g. the structural component 125 of the housing 120 in FIG. 1).

Figure 3:
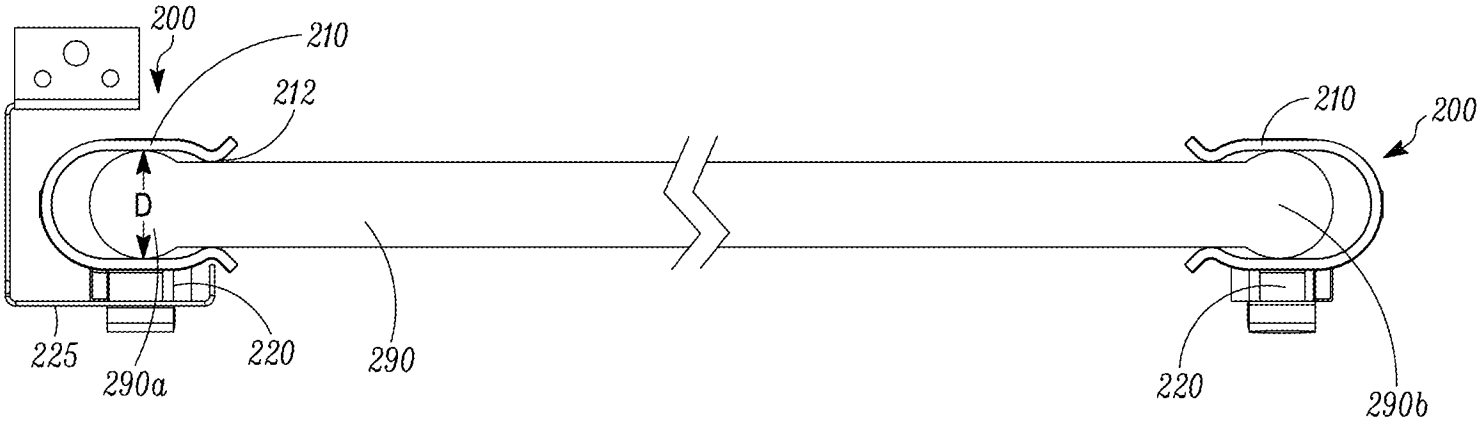
FIG. 3 illustrates a top view of a heat exchanger equipped with mounting clips according to the embodiment as shown in FIG. 2.

Referring to FIGS. 2 and 3 together, one or more mounting clips 200 can be used to mount a heat exchanger 290 (e.g. a microchannel heat exchanger) to a structural component 225 of a housing. In some embodiments, the receiver portion 210 can be configured to receive an end portion 290*a* or 290*b* of the heat exchanger 290. The clip portion 220 can be configured to be attachable to the structural component 225.

In the illustrated embodiment, the heat exchanger 290 can be a microchannel heat exchanger. The end portions 290*a* and 290*b* may correspond to headers of the heat exchanger 290. The receiver portion 210 can be configured to accommodate a shape/profile of the headers. The receiver portion 210 includes two legs 213, which have inner protrusions 214 forming an open side 212. In some embodiments, the legs 213 are biased so that the open side 212 can be configured to be smaller than a diameter D of the header. That is, a distance between the inner protrusions 214 is smaller than the diameter D of the header. The legs 213 are movable to allow insertion of a portion of the heat exchanger, e.g. the end portion 290*a*, 290*b*.

When the mounting clip 200 is attached to the heat exchanger 290, the end portions 290*a*, 290*b* header can push the inner protrusion 214 apart so as to open up the open side 212. After the header passes the inner protrusions 214 of the open side 212, the open side 212 can close down. The inner protrusions 214 can help retain the header in the receiver portion 210.

It is to be appreciated that the receiver portion 210 can be varied to accommodate different types and/or configurations of heat exchangers.

Figure 4:
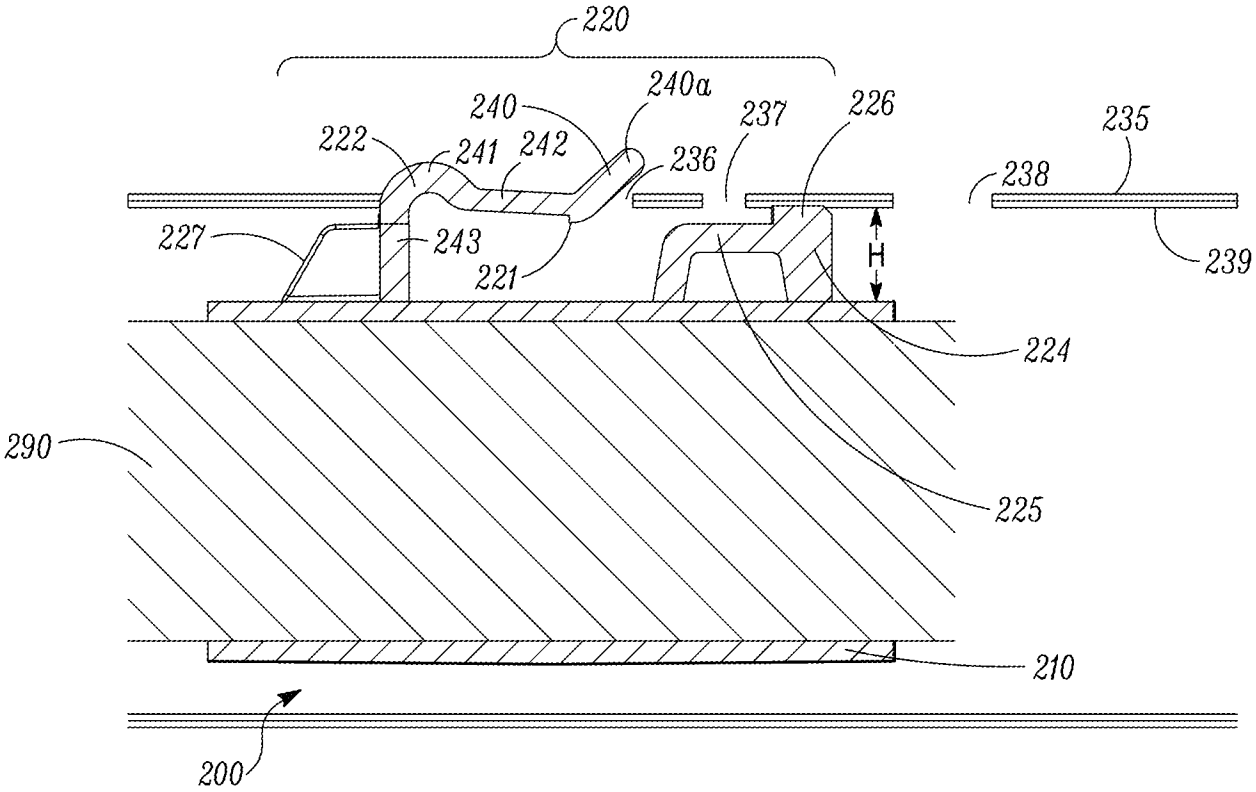
FIG. 4 illustrates a sectional view of the mounting clip as shown in FIG. 2, where a clip portion of the mounting clip is placed in a clip opening of a structural component before the clip portion of the mounting clip engages the structural component.
Figure 5:
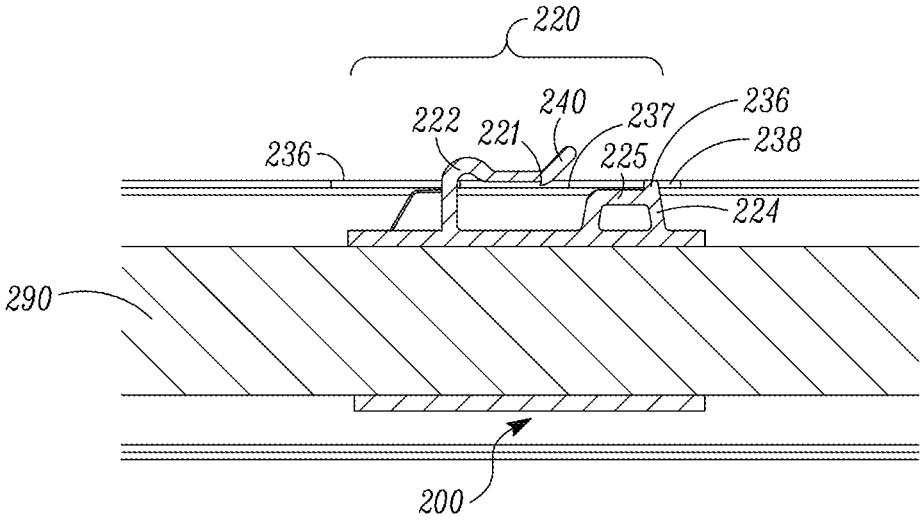
FIG. 5 illustrates a sectional view of the mounting clip as shown in FIG. 2, where the clip portion of the mounting clip engages the structural component.
Figure 6:
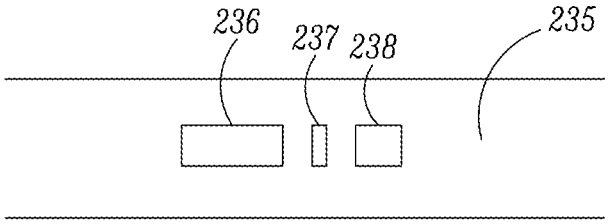
FIG. 6 illustrates a side view of a structural component.

Referring to FIGS. 4, 5 and 6 together, details of the clip portion 220 and a method of its use are further illustrated and described. The clip portion 220 includes a clip 222 and a support 224. The support 224 is configured to include a relatively flat platform 225 and a protruded engaging part 226 that has a height H from a surface of the receiver portion 210.

The clip 222, as shown in FIG. 4, also includes a first portion 242, a second portion 243 and a transition portion 241 between the first portion 242 and the second portion 243. In the sectional as shown in FIG. 4, the first portion 242 is generally horizontal relative to the receiver portion 210, and the second portion 243 is generally extended away from, e.g. vertical relative to, the receiver portion 210. The transition portion 241 has a relatively rounded profile, which can function as a biasing or spring-like member of the clip 222. The first portion may include an engaging member 221. The engaging member 221 may be configured to be lower than the height H in the orientation shown. The engaging member 221 can be configured as a shoulder or barb-like structure.

The clip 222 and the support 224 may be configured to have other features, for example, to enhance structural integrity. For example, the clip 222 may be configured to have a supporting wall 227 to enhance the structural integrity of the clip 222. In the illustrated embodiment, the supporting wall 227 is attached to the second portion 243 of the clip 222.

The clip portion 220 is configured to engage a structural component 235 (e.g. similar to the structural component 125 of the housing 100 as illustrated in FIG. 1). Referring to FIG. 6, the structural component 235 may include a first opening 236, a second opening 237 and a third opening 238, which are configured to receive the clip 222, the engaging member 221, and the protruded engaging part 226 respectively when the clip portion 220 engages the structural component 235.

It is to be appreciated that a plurality of mounting clips 200 may be used to mount a heat exchanger. One or more structural components 235 can have a set or sets of first, second and third openings to accommodate the plurality of mounting clips.

FIGS. 4 and 5 illustrate how the clip 222 engages the structural component 235. Referring to FIG. 4, the first opening 236 receives the clip 222. A size of the first opening 236 is configured so that the clip 222 can pass through the first opening 236. The protruded engaging part 226, at the state as illustrated in FIG. 4, can sit on a back 239 of the structural component 235. The engaging member 221 generally is positioned relatively lower than the back 239 of the structural component 235 in the state as illustrated in FIG. 4.

Referring to FIGS. 4 and 5 together now, the clip 222 can be snapped onto the structural component 235 by pushing the mounting clip 200, for example, from left to right in the orientation as shown. During this process, the clip 222 can be pushed upwardly by the structural component 235 (see FIG. 4).

The clip 222 includes a tab 240. An end 240*a* of the tab 240 is configured to angle away from the first portion 242 in the state as shown in FIG. 4. Referring back to FIG. 2, the end 240*a* of the tab 240 angles away relative to the receiver portion 210. The tilted end 240*a* may provide a guiding ramp for the clip 220 when the mounting clip 200 is moved from left to right relative to the structural component. As the clip 222 moves rightward relative to the structural component 235, the engaging member 221 can be received by the second opening 237, and the protruded engaging part 226 can be received by the third opening 238 (see FIG. 5). In the state as shown in FIG. 5, the clip 222 can push the flat platform 225 against the structural component 235. The engaging member 221 and the protruded engaging part 226 may engage the structural component 235 within and on sides of the second and third openings 237, 238, respectively. These features help stabilize the engagement between the clip 222 and the structural component 235.

To remove the clip 222 from the structural component 235, a user can lift the tab 240 upwardly (e.g. by a finger or a tool) so that the engaging member 221 is lifted out of the second opening 237. The mounting clip 200 can be moved relatively leftward in the orientation shown. The mounting clip 200 can be disengaged from the structural component 235.

In the illustrated embodiment, the clip 222 is positioned on an outer surface of one of the legs 213. A direction to engage the clip 222 to the structural component 235 is generally traverse (e.g. perpendicular to) a direction of engaging the open side 212 to a portion of a heat exchanger. For example, such a configuration can be useful when the heat exchanger is mounted or arranged on a HVAC unit as a bank, where the heat exchanger is upright or slanted, e.g. as shown in FIG. 1. The engaging member 221 and the protruded engaging part 226 can use the force of gravity to be supported by sides of the openings, e.g. 237, 238, while also being snap fitted into the opening 237 by engaging member 221.

The mounting clip as illustrated herein allows a user to put the mounting clip to a heat exchanger relatively quickly and easily. Referring back to FIG. 1, one or more of the mounting clip as illustrated herein can be used to mount the heat exchanger 110 to the structural component 125. The user can also disengage or remove the mounting clip(s) from the structural component of a HVAC housing relatively easily. In some embodiments, the mounting clip(s) can be used without a tool. Using the mounting clip(s) can help reduce time and cost associated with assembling the HVAC unit.

ASPECTS

Any of aspects 1-7 may be combined with any of aspects 8-16.

Aspect 1. A mounting clip for mounting a heat exchanger to a structural component, comprising:

a receiver portion configured to receive a portion of the heat exchanger; and a clip portion;

wherein the clip portion includes a clip and a support, and the clip and the support are configured to engage the structural component.

Aspect 2. The mounting clip of aspect 1, wherein the clip includes an engaging member, and the engaging member is configured to engage the structural component in a mounting opening of the structural component.

Aspect 3. The mounting clip of aspects 1-2, wherein the support further includes a protruded engaging part, and the protruded engaging part is configured to engage the structural component in a mounting opening of the structural component.

Aspect 4. The mounting clip of aspects 1-3, wherein the clip includes an engaging member, and the engaging member is configured to be lower than a height of the protruded engaging part.

Aspect 5. The mounting clip of aspects 1-4, wherein the receiver portion includes a mounting opening that is configured receive the heat exchanger.

Aspect 6. The mounting clip of aspects 1-5, wherein the clip is supported by a supporting wall.

Aspect 7. The mounting clip of aspects 1-6, wherein the clip includes a tab having an end that is configured to angle away from the receiver portion.

Aspect 8. A HVAC unit, comprising:

a heat exchanger;

a housing having a structural component; and a mounting clip for mounting the heat exchanger to a structural component, wherein the mounting clip includes:

a receiver portion configured to receive a portion of the heat exchanger; and a clip portion;

wherein the clip portion includes a clip and a support, and the clip and the support are configured to engage the structural component.

Aspect 9. The HVAC unit of aspect 8, wherein the clip includes an engaging member, and the engaging member is configured to engage the structural component in a mounting opening of the structural component.

Aspect 10. The HVAC unit of aspects 8-9, wherein the support further includes a protruded engaging part, and the protruded engaging part is configured to engage the structural component in a mounting opening of the structural component.

Aspect 11. The HVAC unit of aspect 10, wherein the clip includes an engaging member, and the engaging member is configured to be lower than a height of the protruded engaging part.

Aspect 12. The HVAC unit of aspects 8-11, wherein the receiver portion includes a mounting opening that is configured receive the heat exchanger.

Aspect 13. The HVAC unit of aspects 8-12, wherein the clip is supported by a supporting wall.

Aspect 14. The HVAC unit of aspects 8-13, wherein the clip includes a tab having an end that is configured to angle away from the receiver portion.

Aspect 15. The HVAC unit of aspects 10-14, wherein the clip includes an engaging member; the structural component includes a first opening, a second opening and a third opening respectively; and the first opening is configured to receive the clip, the second opening is configured to receive the engaging member, and the third opening is configured to receive the protruded engaging part.

Aspect 16. The HVAC unit of aspects 10-15, wherein the heat exchanger is a condenser and the HVAC unit is an outdoor condensing unit.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

What claimed is:

1. A mounting clip for mounting a heat exchanger to a structural component, comprising:

a first clip having a receiver portion with two legs forming an internal surface that is configured to receive a portion of the heat exchanger; and a second clip, the second clip having a clip member and a support, the clip member and the support are configured to engage the structural component, the clip member and support are located along an outer surface of one of the legs of the first clip, wherein the clip member and support are positioned away from and outside of the internal surface of the first clip, and the support further includes a protruded engaging part, the protruded engaging part is configured to engage the structural component in a mounting opening of the structural component.

2. The mounting clip of claim 1, wherein the clip member includes an engaging member, and the engaging member is configured to engage the structural component in a different mounting opening of the structural component.

3. The mounting clip of claim 2, wherein the engaging member is configured to be lower than a height of the protruded engaging part.

4. The mounting clip of claim 1, wherein the receiver portion includes inner protrusions that are configured to receive the heat exchanger.

5. The mounting clip of claim 1, wherein the clip member is supported by a supporting wall.

6. The mounting clip of claim 1, wherein the clip member includes a tab having an end that is configured to angle away from the receiver portion.

7. An HVAC unit, comprising:

a heat exchanger;

a housing having a structural component; and a mounting clip to mount the heat exchanger to the structural component, wherein the mounting clip includes:

a first clip having a receiver portion forming an internal surface configured to receive a portion of the heat exchanger; and a second clip;

wherein the second clip having a clip member and a support, the clip member and the support are configured to engage the structural component, the clip member and support are located along an outer surface of the first clip, wherein the clip member and support are positioned away from and outside of the internal surface of the receiver portion, wherein the support includes a protruded engaging part, the protruded engaging part is configured to engage the structural component, wherein the clip member includes an engaging member, the engaging member is configured to engage the structural component.

8. The HVAC unit of claim 7, wherein the engaging member is configured to be lower than a height of the protruded engaging part.

9. The HVAC unit of claim 7, wherein the receiver portion includes inner protrusions that are configured to receive the heat exchanger.

10. The HVAC unit of claim 7, wherein the clip member is supported by a supporting wall.

11. The HVAC unit of claim 7, wherein the clip member includes a tab having an end that is configured to angle away from the receiver portion.

12. The HVAC unit of claim 7, wherein the structural component includes a first opening, a second opening and a third opening respectively; and the first opening is configured to receive the clip member, the second opening is configured to receive the engaging member, and the third opening is configured to receive the protruded engaging part.

13. The HVAC unit of claim 12, wherein the heat exchanger is a condenser and the HVAC unit is an outdoor condensing unit.

14. An HVAC unit, comprising:

a heat exchanger;

a housing having a structural component; and a mounting clip for mounting the heat exchanger to the structural component, wherein the mounting clip includes:

a receiver portion configured to receive a portion of the heat exchanger; and a clip portion, the clip portion includes a clip and a support, the clip and the support are configured to engage the structural component, wherein the support further includes a protruded engaging part, and the protruded engaging part is configured to engage the structural component, and wherein the clip includes an engaging member; the structural component includes a first opening, a second opening and a third opening respectively, and the first opening is configured to receive the clip, the second opening is configured to receive the engaging member, and the third opening is configured to receive the protruded engaging part.

15. The mounting clip of claim 1, wherein the support includes a flat platform, the flat platform is configured to abut against the structural component.

16. The mounting clip of claim 2, wherein the clip member includes a first portion that is parallel to the outer surface, a second portion that is perpendicular to the outer surface, the first portion extends from the second portion, and the engaging member extends from the first portion.

* * * * *